United States Patent [19]

Tusinski et al.

[11] 4,328,060

[45] May 4, 1982

[54] OPHTHALMIC LENS DEBLOCKING - METHOD AND APPARATUS

[75] Inventors: Joseph Tusinski; Phillip D. Hill; Clarence J. Lund, all of Muskogee, Okla.

[73] Assignee: Coburn Optical Industries, Inc., Muskogee, Okla.

[21] Appl. No.: 181,523

[22] Filed: Aug. 26, 1980

[51] Int. Cl.[3] ..... B32B 1/00

[52] U.S. Cl. ..... 156/344; 51/277; 156/584

[58] Field of Search ..... 156/344, 584; 51/216 LP, 277

[56] References Cited

U.S. PATENT DOCUMENTS 3,050,436 8/1962 Stepanski et al. ..... 156/344

3,091,062 5/1963 Suddarth ..... 51/277

*Primary Examiner*—James J. Bell

*Attorney, Agent, or Firm*—John J. Byrne

[57] ABSTRACT

A method and apparatus for removing a block releasably adhered to the surface of an ophthalmic lens.

The apparatus includes a base and a first and second stanchion extending upwardly from the base. First and second opposing gripping members are mounted at the distal ends of the first and second stanchions respectively wherein an operator may place lateral surfaces of a block adhered to the surface of an ophthalmic lens between the opposing gripping members and peel the lens away from the secured block using the first gripping means as a fulcrum.

12 Claims, 9 Drawing Figures

FIG. 4
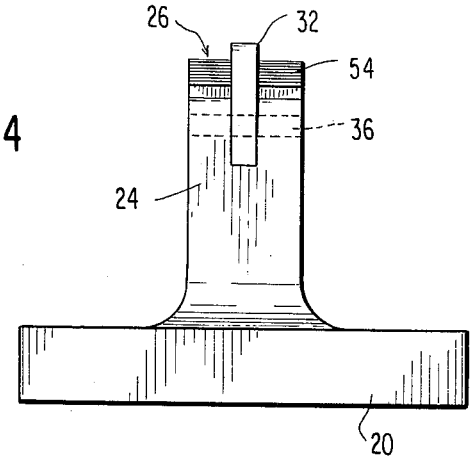
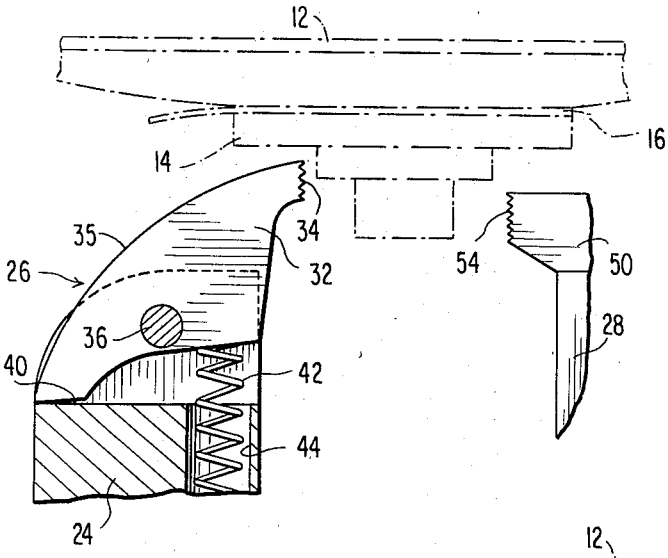
FIG. 5
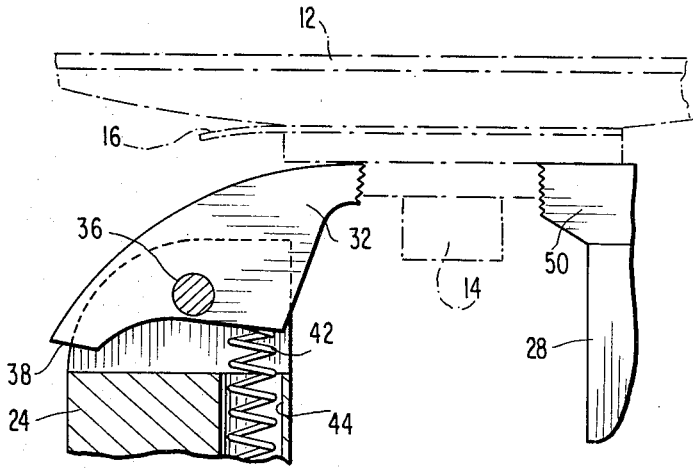
FIG. 6

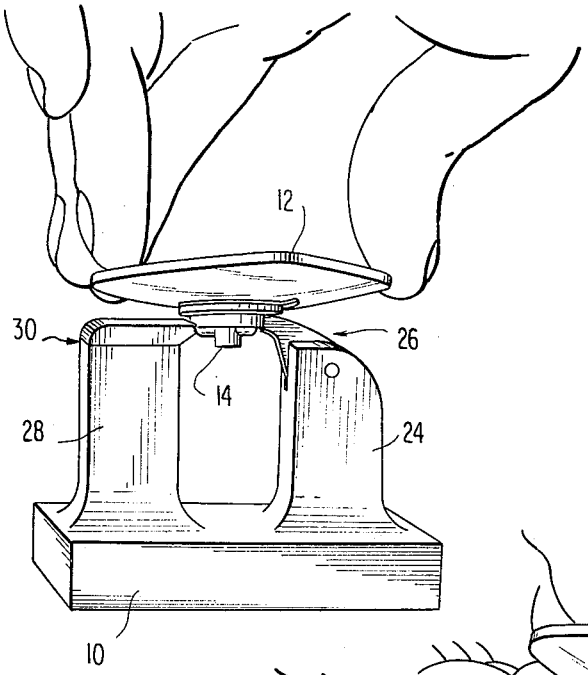
FIG. 7
FIG. 8
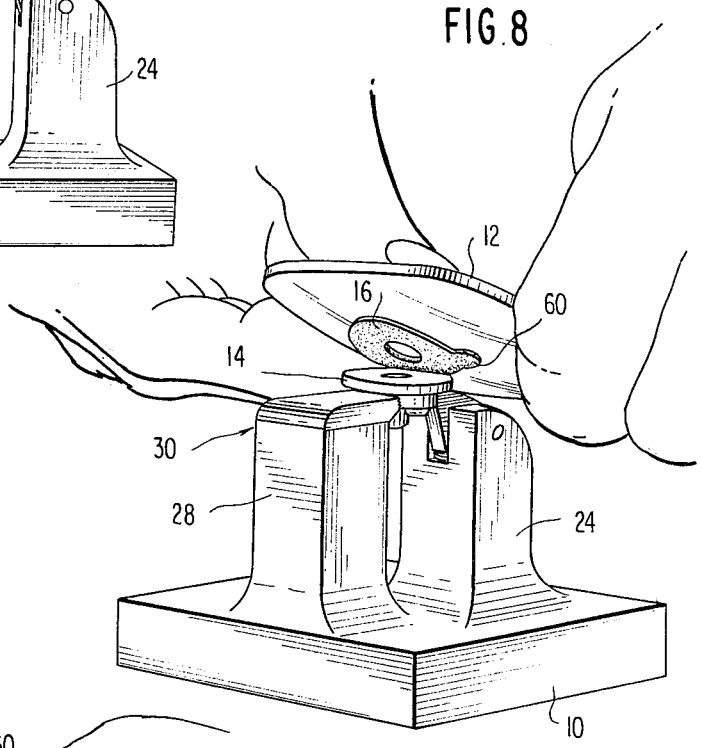
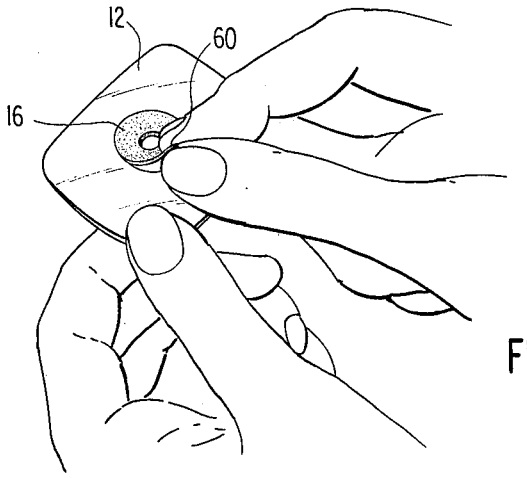
FIG. 9

OPHTHALMIC LENS DEBLOCKING - METHOD AND APPARATUS

DESCRIPTION

Technical Field

This invention relates to the formation and handling of ophthalmic lenses. More specifically, the invention comprises a method and apparatus for removing a work block releasably adhered to the surface of an ophthalmic lens.

In the formation of an ophthalmic lens, a generally cylindrical lens disc or blank is first molded from glass or plastic. This lens blank is fashioned with a convex surface on one end and a concave surface on the other. The lens is then accurately mounted upon a grinding or generating apparatus where a torodial surface of compound prescriptive valve is rough ground into the concave portion of the lens.

Following the initial generating operation, the ophthalmic lens is fined and polished to a final prescriptive value. Left and right lenses are then mounted upon an edge grinding machine to cut the outer peripheral shape required of the lens in order to be compatible with eye glass frames. Finally, the lens edge surfaces may be fine polished or honed to be smooth and free from scratches and/or other aberrations.

In each of these processes it is necessary to accurately align and firmly hold the lens with the prescriptive meridians accurately on station with respect to an abrading tool. This mounting requirement is achieved by attachment of a generally cylindrical lens block to the convex surface of the lens.

Initially a lens block was attached to an ophthalmic lens with a wax or pitch composition. Following lens formation the block would be removed from the lens blank and immersed in a solvent or heated to remove pitch deposits. Such a technique is disclosed in U.S. Fritzsche Pat. No. 2,680,697, of common assignment with the subject application.

More recently lens blocking or chucking has been achieved by releasably adhering a block to a lens blank with a low temperature melting alloy. Generally cylindrical lens blocks of this type may be facilely removed from a lens blank by application of a lens deblocking device such as disclosed in U.S. Suddarth Pat. No. 3,091,062, also of common assignment with the subject application.

In the most recent past lens blocking has been achieved by applying a thin pad or disc coaxially upon a lens blank. The disc is coated on both sides with an adhesive coating and thus the pad is self-adhering to the ophthalmic lens. A block is then accurately aligned with the base and cross meridians and adhered to the outer adhesive surface of the pad.

In order to remove a block of this type from a finished lens, an operator conventionally grasps the edges of the lens, inserts the block vertically into a cavity dimensionally compatible with the peripheral configuration of the block and rotates the lens to twist and shear the block from the adhesive pad.

While the foregoing adhesive pad deblocking technique has achieved a degree of acceptance in the art, room for significant improvement remains. In this connection, the dual surfaced adhesive pad is designed to exhibit substantial resistance to shear in order to securely mount the lens with respect to the block during an abrading operation. Accordingly a substantial torque must be applied to release the lens from the block. With this deblocking method and apparatus it is even recommended that a towel or cloth be wrapped around the lens to protect an operator's hands.

The difficulties suggested in the proceeding are not intended to be exhaustive, but rather are among many which may tend to reduce the effectiveness and user satisfaction of prior adhesive pad deblocking methods and apparatus. Other noteworthy problems may also exist; however, those presented above should be sufficient to demonstrate that ophthalmic lens deblocking techniques appearing in the past will admit to worthwhile improvement.

OBJECTS OF THE INVENTION

It is therefore a general object of the invention to provide a novel ophthalmic lens deblocking method and apparatus which will minimize or obviate difficulties of the type previously described.

It is a particular object of the invention to provide a novel lens deblocking method and apparatus which is quick and relatively effortless to enable a block to be facilely removed from an ophthalmic.

It is another object of the invention to provide a novel lens deblocking method and apparatus wherein an operator is not required to wear gloves or utilize a protective cloth in handling a lens during a deblocking operation.

It is a further object of the invention to provide a novel lens deblocking method and apparatus wherein it is not necessary to overcome the shear strength of an adhesive block mounting pad.

It is still another object of the invention to provide a novel lens deblocking method and apparatus wherein a degree of variation in lateral block dimensions may be facilely accomodated.

BRIEF SUMMARY OF A PREFERRED EMBODIMENT OF THE INVENTION

A preferred embodiment of the invention which is intended to accomplish at least some of the foregoing objects comprises a base member and a first and second stanchion upwardly extending with respect to the base. First and second gripping means are fashioned at the distal ends of the first and second stanchions respectively and in a mutually opposing posture.

In operation a block portion of an ophthalmic lens and block is inserted between the mutually opposing first and second gripping means. The lens is then pivoted away from the block using the first gripping means as a fulcrum while the second gripping means maintains the block between the first and second gripping assemblies.

BRIEF DESCRIPTION OF DRAWINGS

Other objects and advantages of the present invention will become apparent from the following detailed description of a preferred embodiment thereof taken in conjunction with the accompanying drawings, wherein:

FIG. 4 is an end view of the lens deblocking apparatus depicted in FIGS. 1–3;

FIG. 5 is a partial detail view of mutually opposing block gripping members with a lens and block depicted in phantom just prior to being positioned between the block gripping members;

FIG. 6 is a partial detail view similar to FIG. 5 with the lens block shown in phantom securely engaged between opposing gripping members; and FIGS. 7–9 disclose an operative sequence wherein an ophthalmic lens to be deblocked is shown with the block being inserted between two gripping jaws, the lens being peeled away from the lens block and ultimate removal of a double sided self-adherent block mounting pad.

DETAILED DESCRIPTION

Figure 1:
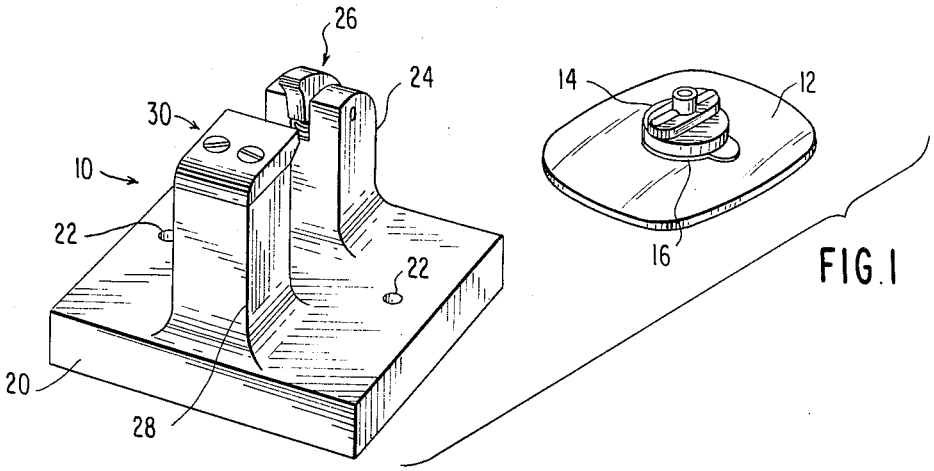
FIG. 1 is an axonometric view of an ophthalmic lens deblocking apparatus in accordance with preferred embodiment of the subject invention and an ophthalmic lens and block ready to be separated.

Referring now to the drawings, wherein like numerals indicate like parts, FIG. 1 discloses an axonometric view of an ophthalmic lens deblocking device 10 in accordance with a preferred embodiment of the invention. FIG. 1 also discloses a ground lphthalmic lens 12 and lens block 14. The lens block 14 is attached to the lens 12 by the provision of a disc 16 having an adhesive coating on both sides thereof.

Figure 2:
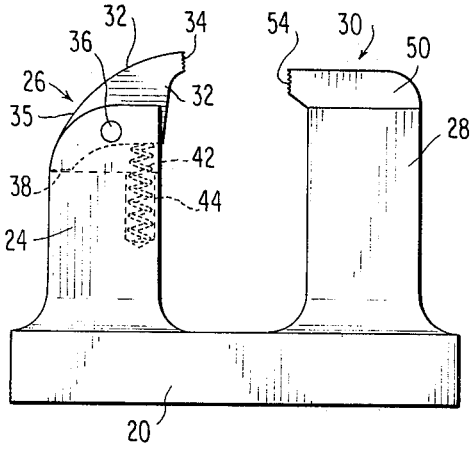
FIG. 2 is a side view of the lens deblocking apparatus depicted in FIG. 1 and specifically discloses a pivotally mounted block gripping member which is biased in an open posture.
Figure 3:
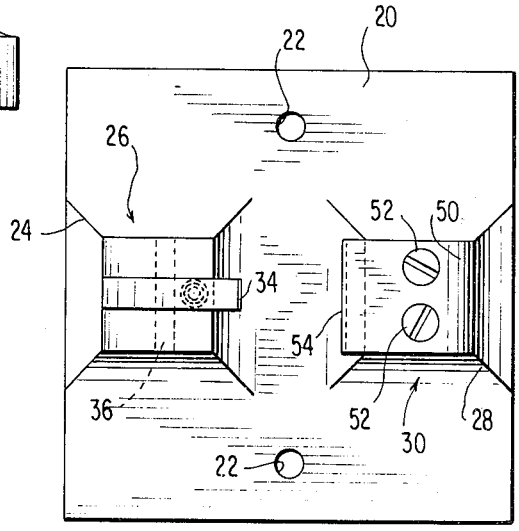
FIG. 3 is a top view of the lens deblocking apparatus depicted in FIG. 2.

Referring to FIGS. 2–4, in addition to FIG. 1, the subject deblocking apparatus 10 includes a base 20 having a generally orthogonal exterior configuration and a flat bottom surface operable to rest upon a work surface. If desired, the base 20 may be mounted upon the work surface by threaded fasteners extending through aperatures 22 and into the work surface.

A first stanchion 24 projects generally perpendicularly from the base 20 and carries at the distal end thereof a first gripping assembly 26 operable to engage a lateral surface of the lens block 14.

A second stanchion 28 also projects generally perpendicularly from the base 20 and in a generally parallel posture with respect to the first stanchion 24. The second stanchion carries at the distal end thereof a second gripping assembly 30 positioned in a mutually opposing position with respect to the first gripping assembly. The second gripping assembly 30 is operable to engage a generally diametrical surface of the lens block 14 with respect to the position of engagement of gripping assembly 26.

The first gripping assembly 26 comprises a lens block gripping member 32 having a roughened or serrated surface 34 formed by generally parallel grooves. This roughened surface 34 is operable to securely engage and grip a lateral surface of the lens block 14. The first gripping member 32 is fashioned with an upper arcuate surface 35 to accomodate pivoting action of the lens 12 away of the lens block 14 as will be discussed more fully below. The gripping member 32 is pivotally mounted upon a bearing shaft 36. The shaft in turn is carried by a bifurcated distal end of stanchion 24.

A stop surface 38 is formed on the gripping member and cooperates with a landing area 40 on the stanchion 24 to limit counter clockwise pivotal movement of the gripping member about shaft 36, note FIG. 2. The stop 38 is normally biased into engagement with the land 40 by a compression spring 42 mounted within a well 44 in the stanchion 24. This spring maintains the first gripping assembly 26 in a normally open posture with respect to the second gripping assembly, note FIG. 5.

The second gripping assembly 30 comprises a platon 50 which may be securely mounted upon the distal end of stanchion 28 by a pair of threaded fasteners 52 such as screws or machine bolts. One edge of the platen 50 is provided with a roughened or serrated surface 54, such as laterally extending parallel grooves, to operably engage and grip a lateral surface of the lens block 14.

As depicted in FIG. 5, the upper most portion of gripping member 32 is normally elevated, in the open position, with respect to the uppermost portion of gripping member 50. When a lens block is inserted between the first and second gripping members, and the first gripping member is pivoted clockwise to firmly engage the lens block 14, note FIG. 6, the gripping members achieve approximately the same horizontal position to provide secure clamping action.

Referring now to FIGS. 7–9, there will be seen a sequence of views wherein an operator is able to facilely deblock an ophthalmic lens in accordance with the subject invention.

More specifically, an operator first inserts lateral edge surfaces of the lens block 14 between the first pivotal gripping member 26 and the second stationery gripping member 30. A lateral surface of the lens block 14 is then firmly positioned against the stationery gripping assembly 30. The upper arcuate surface 35 of the first gripping assembly 26 is engaged by the lens block 14 and the first gripping assembly is pivoted into secure engagement with a lateral surface of the lens block.

The operator then pivots and peels the lens 12 away from the lens block 14 using the first pivotal gripping assembly 26 as a fulcrum. This pivotal, peeling action of the lens applies a progressive tensile load on the self adhering adhesive pad 16. Although the adhesive properties of the pad are quite strong in shear, the pad is only able to withstand relatively minor tensile loads. Accordingly an operator is able to readily separate the ophthalmic lens from the lens block with a minimum amount of effort.

Once the lens 12 is removed from the block 14, the self adhering pad may be stripped from the lens by pulling on a release tab 60. Also upon separation of the lens and block, the compression spring 42 will automatically bias the first gripping assembly back into an open posture so that the block may be easily recovered for subsequent use.

Major Advantages of the Invention

After reviewing the foregoing description of a preferred embodiment of the invention, in conjunction with the drawings, it will be appreciated by those skilled in the art that several distinct advantages are obtained by the subject invention.

Without attempting to detail all of the desirable features specifically and inherently set forth above, a major advantage of the invention is the provision of a dual stanchion and gripping assembly arrangement which enables an operator to grip opposing edges of a lens block and, using the first gripping member 32 as a fulcrum, pivot/peel the lens away from the block. This pivotal, peeling action acts against the weak tensile force of the adhesive member 16 as opposed to the relatively high shear strength of the block mounting design.

The pivotal action of the first gripping member 32 enables a degree of dimensional variation in the lens block and also facilitates insertion and removal of the lens block from the deblocking apparatus.

The arcuate upper surface 35 of the first gripping member 32 facilitates the pivotal, peeling action of the lens away from the lens block.

The compression spring 42 advantageously maintains the deblocker in a ready position and automatically releases the block upon separation of the lens from the block.

In describing the invention, reference has been made to a preferred embodiment. Those skilled in the art, however, and familiar with the disclosure of the subject invention, may recognize additions, deletions, modifications, substitutions and/or other changes which will fall within the purview of the subject invention.

We claim:

1. An apparatus for removing a lens block releasably adhered to the surface of an ophthalmic lens comprising:

a base, a first stanchion upwardly extending from said base;

a second stanchion upwardly extending from said base in a posture adjacent to but spaced from said first stanchion;

first gripping means fashioned at a distal end of said first stanchion for engaging one lateral surface of an ophthalmic lens block;

second gripping means fashioned at a distal end of said second stanchion in an operative posture opposing said first gripping means for engaging a generally opposite lateral surface of the ophthalmic lens block, wherein an operator may place the block portion of an ophthalmic lens and block between said mutually opposing first and second gripping means and remove the lens from the block by pivoting and peeling the lens away from the block using said first gripping means as a fulcrum while said second gripping means maintains the block between said first and second gripping means.

2. An apparatus for removing a lens block releasably adhered to the surface of an ophthalmic lens as defined in claim 1 wherein said first gripping means comprises:

a grip member pivotally mounted upon the distal end of said first stanchion and being operable to be pivoted into engagement with the lateral surface of the block.

3. An apparatus for removing a lens block releasably adhered to the surface of an ophthalmic lens as defined in claim 2 and further comprising:

means for biasing said grip member of said first gripping means away from engagement with the block to facilitate insertion of the block between said grip member of said first gripping means and said second gripping means.

4. An apparatus for removing a lens block releasably adhered to the surface of an ophthalmic lens as defined in claim 3 and further comprising:

stop means fashioned upon said grip member of said first gripping means for limiting the pivoting action of said means for biasing said grip member.

5. An apparatus for removing a lens block releasably adhered to the surface of an ophthalmic lens as defined in claim 2 or 3 wherein said second gripping means comprises:

a platen mounted upon the distal end of said second stanchion.

6. An apparatus for removing a lens block releasably adhered to the surface of an ophthalmic lens as defined in claim 5 wherein:

mutually opposing areas of said grip member and said platen are fashioned with roughened surfaces to facilitate gripping action of said surfaces upon generally opposite lateral surfaces of the block.

7. An apparatus for removing a lens block releasably adhered to the surface of an ophthalmic lens as defined in claim 1 wherein said first gripping means comprises:

a grip member mounted at the distal end of said first stanchion and having an upper arcuate surface operable to facilitate pivoting of the lens away from the lens block using the grip member as a fulcrum.

8. An apparatus for removing a lens block releasably adhered to the surface of an ophthalmic lens comprising:

a base;

a first stanchion upwardly extending from said base;

a second stanchion upwardly extending from said base in a generally parallel posture adjacent to but spaced from said first stanchion;

a first gripping member, having an upper arcuate surface and being pivotally mounted at a distal end of said first stanchion for engaging one lateral surface of the lens block; and a second gripping member comprising a platen generally horizontally mounted upon a distal end of said second stanchion for engaging a generally opposite lateral surface of the lens block, wherein an operator may place the block portion of the ophthalmic lens and block between said first and second gripping members and remove the lens from the block by pivoting and peeling the lens away from the block using said first gripping member as a fulcrum while said second gripping member maintains the block between said first and second gripping members.

9. An apparatus for removing a lens block releasably adhered to the surface of an ophthalmic lens as defined in claim 8 and further comprising:

spring means for pivoting said first gripping member away from engagement with the block to facilitate insertion of the block between said first and second gripping members; and a stop surface fashioned upon said first gripping member and a landing area fashioned upon the distal end of said first stanchion which cooperates with said stop to limit the pivotal opening action induced by said spring means upon said first gripping member.

10. An apparatus for removing a lens block releasably adhered to the surface of an ophthalmic lens as defined in claim 8 and further comprising:

a plurality of generally horizontal fashioned across mutually opposing surfaces of said first and second gripping members for facilitating clamping engagement of said first and second gripping members with the lens block.

11. A method for removing a lens block releasably adhered to the surface of an ophthalmic lens comprising the steps of:

inserting lateral edge surfaces of the lens block between a first pivotal gripping member and a second stationery gripping member mounted upon the distal ends of first and second stanchion members respectively;

positioning a first lateral surface of the lens block against the second stationery gripping member;

pivoting the first gripping member into engagement with a second lateral surface of the lens block to grip the lens block between the first and second gripping members; and using the first pivotal gripping member as a fulcrum, pivoting and peeling the ophthalmic lens away from the releasably adhered lens block secured between the first and second gripping members.

12. A method for removing a lens block releasably adhered to the surface of an ophthalmic lens as defined in claim 11 and further comprising the step of:

biasing the first, pivotal, gripping member away from said second, stationery, gripping member to initially maintain a relative open posture between said first and second gripping members to facilitate said step on inserting.

* * * * *